US011741839B2

(12) United States Patent
Ookuma

(10) Patent No.: US 11,741,839 B2
(45) Date of Patent: Aug. 29, 2023

(54) TRAFFIC SAFETY ASSISTANCE DEVICE, MOBILE INFORMATION TERMINAL, AND PROGRAM

(71) Applicant: Quon Technology, Ltd., Kyoto (JP)

(72) Inventor: Hiroshi Ookuma, Gumma (JP)

(73) Assignee: Quon Technology Ltd., Kyoto (JP)

( * ) Notice: Subject to any disclaimer, the term of this patent is extended or adjusted under 35 U.S.C. 154(b) by 128 days.

(21) Appl. No.: 17/594,525

(22) PCT Filed: Apr. 23, 2019

(86) PCT No.: PCT/JP2019/017265
§ 371 (c)(1),
(2) Date: Oct. 20, 2021

(87) PCT Pub. No.: WO2020/217316
PCT Pub. Date: Oct. 29, 2020

(65) Prior Publication Data
US 2022/0198930 A1 Jun. 23, 2022

(51) Int. Cl.
*G08G 1/16* (2006.01)
*G08G 1/005* (2006.01)

(52) U.S. Cl.
CPC ..... *G08G 1/163* (2013.01); *G08G 1/005* (2013.01)

(58) Field of Classification Search
CPC ..... G08G 1/005; G08G 1/163; G08G 1/166; G08G 1/0112; G08G 1/0133;
(Continued)

(56) References Cited

U.S. PATENT DOCUMENTS 10,930,152 B2 * 2/2021 Maeda ..... G08G 1/163
2009/0128311 A1 * 5/2009 Nishimura ..... G06V 40/18 382/103

(Continued)

FOREIGN PATENT DOCUMENTS

JP 2003-006797 A 1/2003
JP 2003-331396 A 11/2003

(Continued)

OTHER PUBLICATIONS

International Search Report from International Patent Application No. PCT/JP2019/017265, dated Jul. 23, 2019.

(Continued)

*Primary Examiner* — Sisay Yacob
(74) *Attorney, Agent, or Firm* — Potomac Law Group, PLLC

(57) ABSTRACT

A traffic safety assistance device that can communicate with a plurality of moving objects and holds moving object information and map information, the moving object information including position information of some of the moving objects. The traffic safety assistance device is configured as follows. When position information of a first moving object and information about a second moving object existing around the first moving object are input from a terminal mounted on the first moving object, the traffic safety assistance device stores, in addition to the input position information of the first moving object, position of the second moving object in association with the position information of the first moving object as the moving object information. Upon receiving a traffic information request with position information of a third moving object from a terminal mounted on a third moving object, the traffic safety assistance device responds to the third moving object with map information and information about other moving objects in the vicinity thereof. The traffic safety assistance device
(Continued)

further stores accident history information, and it is more desirable to respond to the third moving object with driving assistance information such as a warning based on the position information of the accident and position information of each moving object.

20 Claims, 4 Drawing Sheets

(58) Field of Classification Search
CPC ..... G08G 1/0145; G08G 1/04; G08G 1/164; H04W 4/38; H04W 4/70; H04W 4/40; H04L 47/10; G01S 13/862; G01S 13/865; G01S 13/867; G01S 13/931; G01S 17/86; G01S 17/931
See application file for complete search history.

(56) References Cited

U.S. PATENT DOCUMENTS

2014/0372561 A1 12/2014 Hisano
2019/0287395 A1* 9/2019 Aoude ..... G08G 1/005
2020/0111363 A1* 4/2020 Maeda ..... G08G 1/0145

FOREIGN PATENT DOCUMENTS

| | | | |
|---|---|---|---|
| JP | 2003-346297 | A | 12/2003 |
| JP | 2007-164328 | A | 6/2007 |
| JP | 2008-234414 | A | 10/2008 |
| JP | 2009-245342 | A | 10/2009 |
| JP | 2013-045238 | A | 3/2013 |
| JP | 2013-149191 | A | 8/2013 |
| JP | 2017-191368 | A | 10/2017 |
| JP | 2018-032180 | A | 3/2018 |
| JP | 2018-147055 | A | 9/2018 |
| JP | 6711982 | B1 | 6/2020 |
| WO | WO 2014/041826 | A1 | 3/2014 |

OTHER PUBLICATIONS

Office Action from Japanese Patent Application No. 2019-549603, dated Jan. 7, 2020.

* cited by examiner

TRAFFIC SAFETY ASSISTANCE DEVICE, MOBILE INFORMATION TERMINAL, AND PROGRAM

TECHNICAL FIELD

The present invention relates to a traffic safety assistance device, a mobile information terminal capable of communicating with the traffic safety assistance device, and a program installed in the mobile information terminal. The invention is used especially suitably for avoidance of bicycle collision accidents.

BACKGROUND ART

The number of traffic accidents is on the decline with the prevalence of traffic safety assistance devices such as vehicle-mounted collision avoidance assistance devices. PTL 1 discloses, for example, a traffic safety driving assistance device in which information tags that transmit information through electromagnetic induction are previously attached to or built in pedestrians, bicycles, wheelchairs, etc. and road information collected at road-side information tag reading means and judged from positions, moving speeds, moving directions, etc. of such pedestrians is transmitted to vehicles to encourage the vehicles to take actions to avoid accidents.

PTL 2 discloses a blind spot monitoring device for vehicles. Images of the surroundings captured from a preceding larger vehicle are transmitted wirelessly to a following vehicle. In the following vehicle, the transmitted images are displayed on a vehicle-mounted device to allow a driver to know existence of other vehicles or road conditions in blind spots. PTL 3 discloses a vehicle traveling assistance device. The vehicle driving assistance device is provided with a means for receiving driving information of another vehicle such as a preceding vehicle, and estimating movement of the vehicle considering positional relationships of multiple vehicles and notification statuses of brake lights, blinkers, etc., existing in blind spots of the own vehicle for the promotion of safe driving. PTL 4 discloses an image management center that collects and accumulates images of the surroundings captured from vehicles and distributes the images upon requests from other vehicles. Usage of images of blind spots of the own vehicle is considered to help prevent accidents.

PRIOR ART DOCUMENT

Patent Document

PTL 1: Japanese Patent Application Laid-Open No. 2003-346297

PTL 2: Japanese Patent Application Laid-Open No. 2003-331396

PTL 3: Japanese Patent Application Laid-Open No. 2007-164328

PTL 4: Japanese Patent Application Laid-Open No. 2003-006797

SUMMARY OF THE INVENTION

Problems to be Solved by the Invention

An analysis of recent traffic accident cases by the inventor has revealed that while the number of accidents involving vehicles is decreasing, the number of accidents involving bicycles is not, and that most of the accidents involving bicycles are head-on collisions. Studies of PTL 1 to PTL 4 by the inventor have shown that the traffic safety assistance techniques disclosed therein are not sufficient to prevent collisions involving bicycles.

The technique described in PTL 1 is blighted in that wearing information tags which they are supposed to wear may become burden on pedestrians or the like, and that those not wearing information tags cannot enjoy the benefit of the traffic safety assistance. In this point, according to PTL 2, PTL 3 and PTL 4, pedestrians or the like are not required to wear information tags since they also are recognized in images of the surroundings captured from vehicles. According to the technique described in PTL 3, information such as traveling conditions of a plurality of vehicles and notification information of blinkers, road shapes, signals, road signs, etc. existing in such areas as blind spots is acquired and provided for the prevention of accidents. However, exchange of information takes place only among mutually authenticated vehicles. If such a device is mounted on a bicycle, it may contribute to traffic safety to some extent. In reality, however, the best possible terminals mountable on a bicycle are smartphones with limited computing performance and battery capacity. Even if a lot of information is gathered from multiple vehicles, smartphones cannot process and utilize effectively such information. The traffic safety assistance device described in PTL 4 is blighted in that even though images captured from vehicles are collected in the image management center and many images are acquired from a plurality of vehicles, images required by a bicycle cannot be selected appropriately and used effectively.

An objective of the invention is to provide a traffic safety assistance system that can avoid accidents involving bicycles by showing bicycle drivers risk of accidents that may occur around them using bicycle-mountable mobile information terminals.

Means for accomplishing the objective above will be described below. Other objectives and novel features will become obvious from the description of the specification and the accompanying drawings.

Means for Solving the Problem

An aspect of the invention is as follows.

A traffic safety assistance device may include an interface capable of communicating with a plurality of moving objects, a storage unit capable of holding moving object information including position information of some of the moving objects and map information, and an information processing unit. The traffic safety assistance device is configured as follows.

In the traffic safety assistance device, position information of a first moving object input from a terminal mounted on the first moving object and information about second moving objects existing around the first moving object are input via the interface. Based on the input information, the information processing unit stores the existence of the second moving objects associated with the position information of the first moving object and the input position information of the first moving object in the storage unit as moving object information.

In response to a traffic information request transmitted, via the interface, together with the position information of the moving object input from the terminal mounted on the third moving object, the information processing unit transmits map information in a predetermined range based on the position of the moving object and information about other moving objects to the terminal mounted on the third moving object.

Here, the area "around (surround of)" a moving object refers to a range in which the moving object can detect other moving objects. The first moving object acquires information about the second moving object in the above aspect of the invention. If the information is acquired by capturing with a camera, for example, the predetermined range is the capturing range of the camera, and if the information is acquired by specifying positions with a radar, the predetermined range is a detection range of the radar.

Effect of the Invention

The effect to be obtained by the above aspect will be briefly described below.

A traffic safety assistance system that can avoid accidents involving bicycles by showing bicycle drivers risk of accidents that may occur around them using bicycle-mountable mobile information terminals can be provided. If the first and third moving objects are bicycles with a mobile information terminal such as a smartphone mounted thereon, even if the second moving object is a pedestrian with no such a mobile terminal, existence of not only the first moving object but also the second moving object is mapped on a map, and their existence is notified upon request from another moving object (the third moving object). Then, the third moving object can take action to avoid accidents as needed.

DETAILED DESCRIPTION OF THE INVENTION

1. Outline of Embodiment

Figure 1:
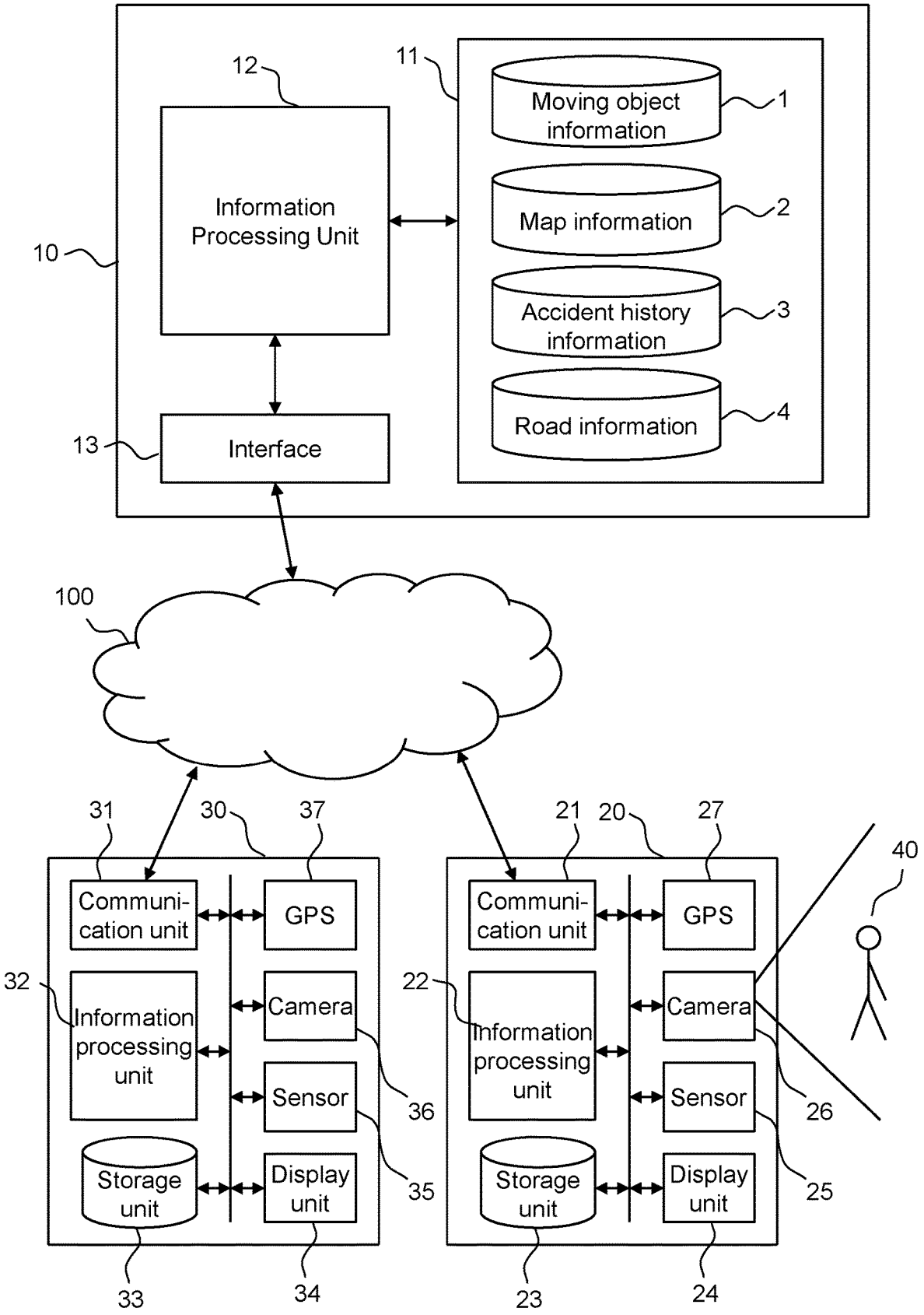
FIG. 1 is a block diagram illustrating a configuration example of a traffic safety assistance device and a mobile information terminal mounted on a plurality of moving objects and capable of communicating with the traffic safety assistance device according to a first embodiment.

First, an outline of a typical embodiment disclosed herein will be described. Reference signs in the drawings also referenced in parentheses in the description of the outline of the typical embodiment merely exemplify those included in the concept of the components to which the reference signs are given.

[1] <Traffic Safety Assistance Device: Collect and Analyze Surround Traffic Information from Bicycles and Distribute Information to Bicycle>

A typical embodiment of the invention is a traffic safety assistance device (10) that includes: an interface (13) capable of communicating with a plurality of moving objects; a storage unit (11) capable of holding moving object information (1) including position information of some of the plurality of moving objects and map information (2); and an information processing unit (12). The traffic safety assistance device (10) is configured as follows (FIG. 1).

Figure 2:
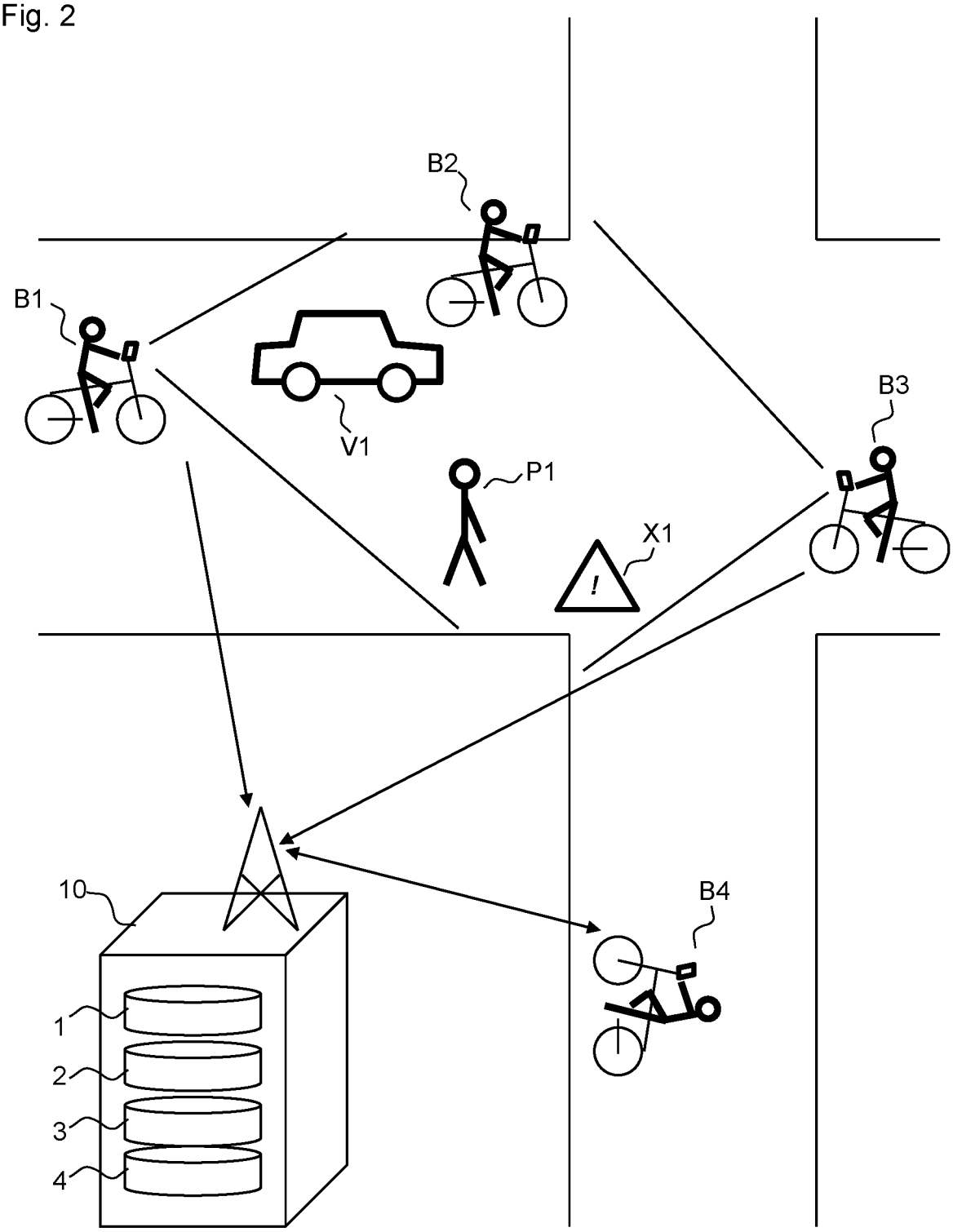
FIG. 2 is a schematic explanatory diagram of an operation of the traffic safety assistance device.
Figure 3:
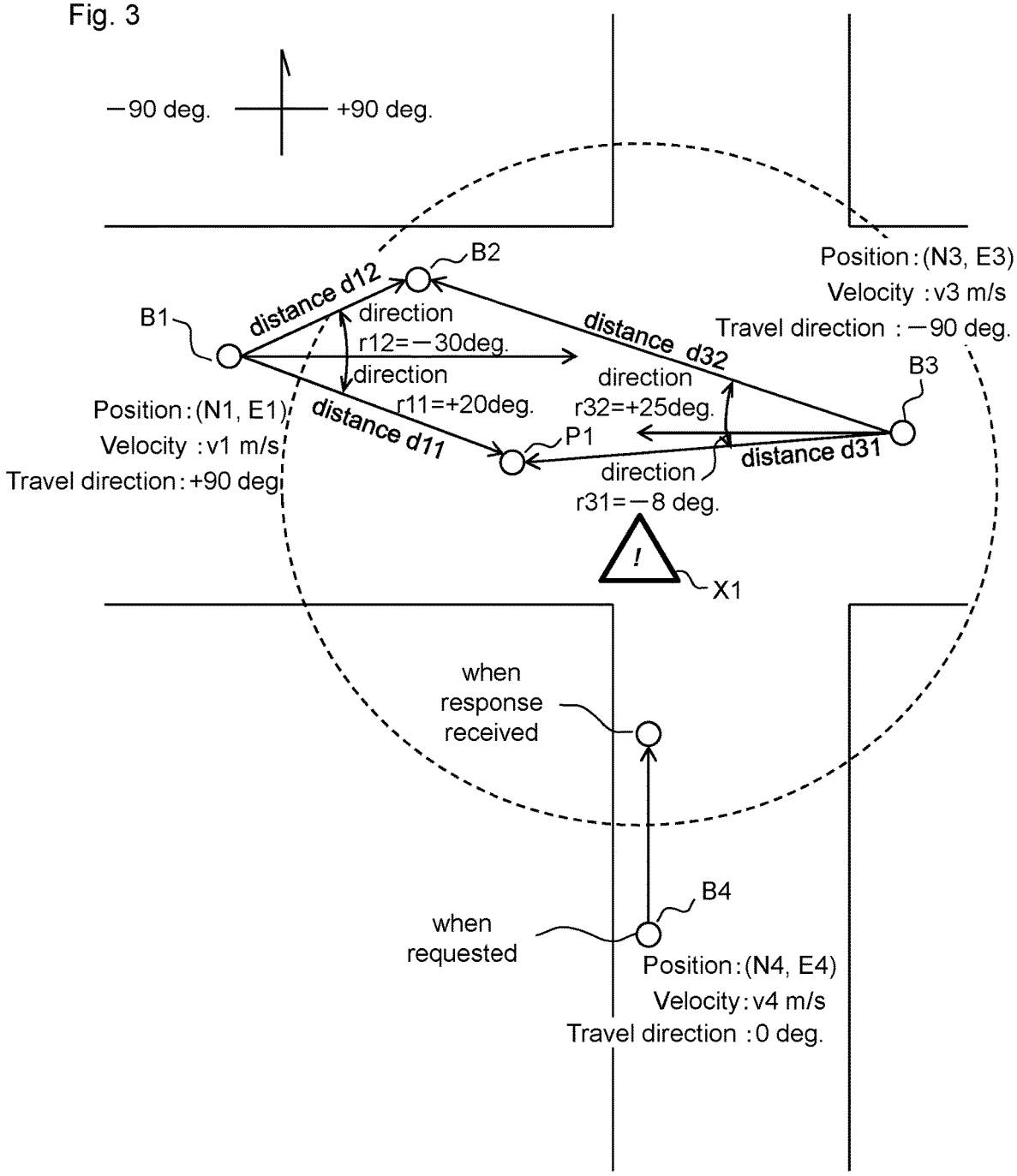
FIG. 3 is an explanatory diagram of an exemplary method of calculating position information of other moving objects.

Based on position information (N1, E1) of a first moving object (B1) input, via the interface, from a terminal mounted on the first moving object (B1) and information about second moving objects (V1, B2, P1) existing around the first moving object (B1), the information processing unit stores the existence of the second moving objects associated with the position information of the first moving object and the input position information of the first moving object in the storage unit as moving object information (FIGS. 2 and 3).

In response to a traffic information request transmitted, via the interface, together with the position information (N4, E4) of a third moving object (B4) input from a terminal mounted on the third moving object (B4), the information processing unit transmits map information in a predetermined range based on the position of the third moving object (B4) and information about other moving objects to the terminal mounted on the third moving object (B4) (FIGS. 2 and 3).

Here, the area "around (surround of)" a moving object refers to a range in which the moving object can detect other moving objects. In [1], the first moving object acquires information about the second moving object. If the information is acquired by capturing with a camera, for example, the predetermined range is the capturing range of the camera, and if the information is acquired by specifying positions with a radar, the predetermined range is a detection range of the radar.

In this manner, a traffic safety assistance system that can avoid accidents involving bicycles by showing bicycle drivers risk of accidents that may occur around them using bicycle-mountable mobile information terminals can be provided. If the first and third moving objects are bicycles with a mobile information terminal such as a smartphone mounted thereon, even if the second moving object is a pedestrian with no such a mobile terminal, existence of not only the first moving object but also the second moving object is mapped on a map, and are provided as a response upon request from another moving object (the third moving object). Therefore, the third moving object can take action to avoid accidents as needed.

[2] <Accident History Information>

In the traffic safety assistance device (10) of [1], the storage unit further stores accident history information (3). When there is accident history information corresponding to the position information of the third moving object attached to the traffic information request, the information processing unit transmits, to the terminal mounted on the third moving object, warning information regarding the accident history information based on the relationship with the accident history information from the moving object information stored in the storage unit (FIG. 2).

In this manner, when the third moving object approaches a point where an accident occurred in the past, the traffic safety assistance device (10) can display a warning to that effect for the driver to prevent a similar accident from occurring again. When there is accident history information corresponding to the position information of the third moving object that has transmitted the traffic information request, e.g., accident history information in the travel direction and when the accident is a collision between a moving object and another moving object in the same travel direction, possibility of reoccurring a similar accident increases if another moving object presently exists at the same position as that of the moving object involved in the past accident. In this case, warning information about the accident history information is transmitted to the third moving object that has transmitted the traffic information request. The warning information may include at least one of the accident history information and information about other moving objects that may possibly be involved in an accident similar to that accident occurred. If there is accident history of the past, the warning information may be transmitted based on the accident history. The warning information may also be transmitted only when there are other moving objects in the same positional relationships as in that accident history.

[3] <Learn Accidents and Near Misses>

In the traffic safety assistance device (10) of [2], the information input from the terminal mounted on the first moving object includes velocity and acceleration of the first moving object and distance information to the second moving object.

When the distance to the second moving object and at least one of velocity or acceleration in the first moving object are equal to or less than a predetermined value specified for each, the information processing unit judges that the first moving object and the second moving object have collided or abnormally approached each other, and adds the judgement result to the accident history information and store the same in the storage unit.

In this manner, the traffic safety assistance device (10) can learn and accumulate accident cases and potential accident cases and can respond with new accident history or warning information similar to accident history upon request to provide traffic information by other moving objects. Therefore, probability of occurrence of accidents can further be reduced.

[4] <Acquire Image Information of Accidents and Near Misses>

In the traffic safety assistance device (10) of [3], when the information processing unit judges that the first moving object and the second moving object abnormally approach each other, the information processing unit requests the terminal mounted on the first moving object to receive image information at the time of the abnormal approach via the interface.

In this manner, when an accident or a potential accident occurs, the traffic safety assistance device (10) can collect detailed information to analyze that accident or the potential accident in more detail.

[5] <Provide Travel Direction Information of Third Moving Object>

In the traffic safety assistance device (10) according to any one of [1] to [4], the traffic information request transmitted from the terminal mounted on the third moving object further includes information about the travel direction and velocity of the third moving object (FIG. 3).

The information processing unit estimates the position of the third moving object at the time when the response is received by the terminal mounted on the third moving object based on the travel direction and the velocity of the third moving object, and then transmits map information corresponding to the estimated position and information about other moving objects around the third moving object to the terminal mounted on the third moving object.

In this manner, the traffic safety assistance device (10) can provide accurate information even when there is significant delay in a communication network between the traffic safety assistance device and the moving object.

[6] <Calculate Position of Second Moving Object>

In the traffic safety assistance device (10) according to any one of [1] to [4], the information processing unit calculates the position of the second moving object based on the position information of the first moving object and information about the second moving object, and then stores the calculated position in the storage unit as moving object information (FIGS. 2 and 3).

In response to the traffic information request, the information processing unit transmits map information within a predetermined range based on the calculated position of the second moving object to the terminal mounted on the third moving object (FIGS. 2 and 3).

In this manner, the position of the second moving object is known more accurately and used for a traffic information request from other moving objects, enabling more accurate information to be provided.

[7] <Program for Collecting and Analyzing Traffic Information and Reporting Traffic Information to Server>

A typical embodiment of the invention is a program that may be installed in and operated on a mobile information terminal (20, 30). The mobile information terminal (20, 30) includes a communication unit (21, 31) and an information processing unit (22, 32). The communication unit (21, 31) is capable of communicating with the traffic safety assistance device (10). The program is configured as follows (FIG. 1).

The traffic safety assistance device holds map information (2) and moving object information (1). The moving object information (1) is capable of mapping position information of each of a plurality of moving objects to the map information.

The mobile information terminal can be mounted on a moving object. When the program installed in and operated on the mobile information terminal, the program causes the information processing unit to extract information about other moving objects (40) existing around the moving object from the images of the surroundings captured from the moving object, set the extracted information as surround information, and transmit the state of the moving object including the position information in association with the surround information to the traffic safety assistance device from the communication unit. Then, the program causes the traffic safety assistance device to update the moving object information.

In this manner, the traffic safety assistance device (10) can collect the position information of a plurality of moving objects and update them sequentially based on the transmitted information, and respond appropriately with surround information of the moving objects upon traffic information request from moving objects.

[8] <Accidents and Near Misses>

In [7], the state of the moving object includes velocity or acceleration of that moving object.

In this manner, the moving object itself can use the information for detecting an accident such as abnormal approach, contact, or a collision with other moving objects, or transmits the information to the traffic safety assistance device (10).

[9] <Store Images when Accidents or Near Misses Occur>

In [8], when the program is operated, the information processing unit judges that an accident or abnormal approach has occurred when the velocity or acceleration of the moving object falls below a predetermined value specified for each and stores images before and after the accident or abnormal approach in a storage unit.

In this manner, the moving object may detect accidents such as abnormal approach, contact, and collisions with other moving objects by itself and record images before and after detection of the accidents, which allows the moving object to have a driving recorder-like function. The storage unit herein may be one mounted on the traffic safety assistance device (10) or one mounted on the mobile information terminal (20, 30).

[10] <Calculate Positions of Other Moving Objects from Surround Information>

In any one of [7] to [9], the surround information includes directions (r11, r12, r31, r32) and distances (d11, d12, d31, d32) of other moving objects from the moving object. When the program is operated, relative velocity or relative acceleration of other moving objects with respect to the own moving object is calculated based on the directions and distances (FIG. 3).

In this manner, the traffic safety assistance device (10) can calculate the positions of other moving objects existing around the moving object based on the transmitted information, and update the moving object information accurately. Especially even when other moving objects have no such communication means and cannot transmit their position information to the traffic safety assistance device, accurate positions of other moving objects are calculated based on the information from surround moving objects, and registered in the traffic safety assistance device (10). Thus, accidents with such moving objects can also be prevented.

[11] <Smartphone Application Program>

In any one of [7] to [10], the mobile information terminal includes a built-in camera (26, 36) and a display unit (24, 34). The mobile information terminal is mounted on the moving object with the display unit disposed at a position within the field of view of a driver facing the travel direction of the moving object and the built-in camera disposed at a position from which the travel direction is capturable.

When the program installed in and operated on the mobile information terminal, the program causes the information processing unit to extract information about other moving objects existing around the moving object from images of the travel direction captured with the built-in camera, set the extracted information as surround information, and transmit the surround information together with the position information to the traffic safety assistance device from the communication unit.

In this manner, the program of the invention can be downloaded, installed, and updated as a general application program for smartphones. Therefore, no special distribution network for distribution, maintenance, and if necessary, billing is required, which helps reduce distributing cost.

[12] <Rear Unit>

Figure 4:
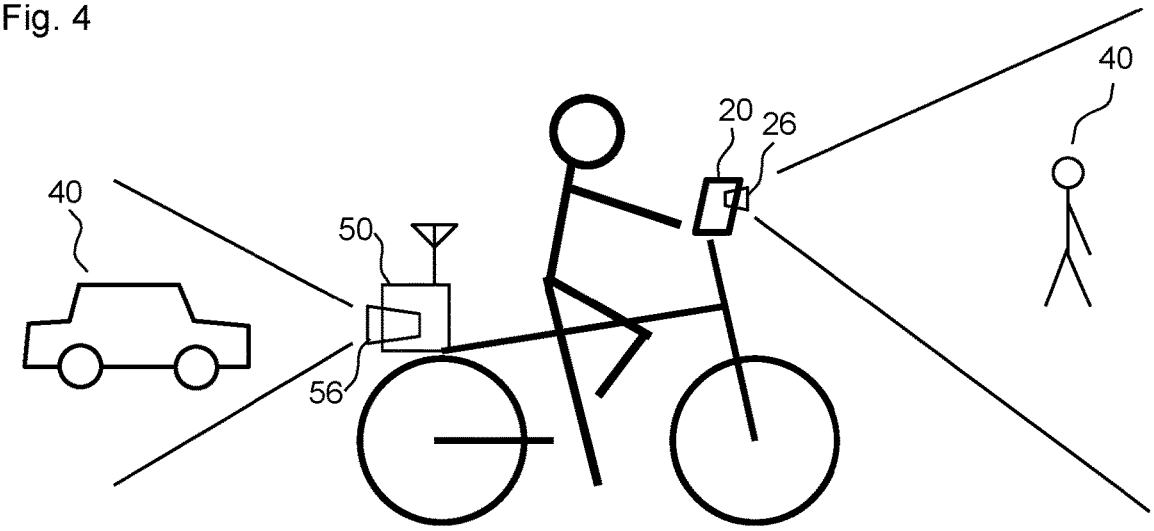
FIG. 4 is an image diagram illustrating an embodiment when the moving object is a bicycle.
Figure 5:
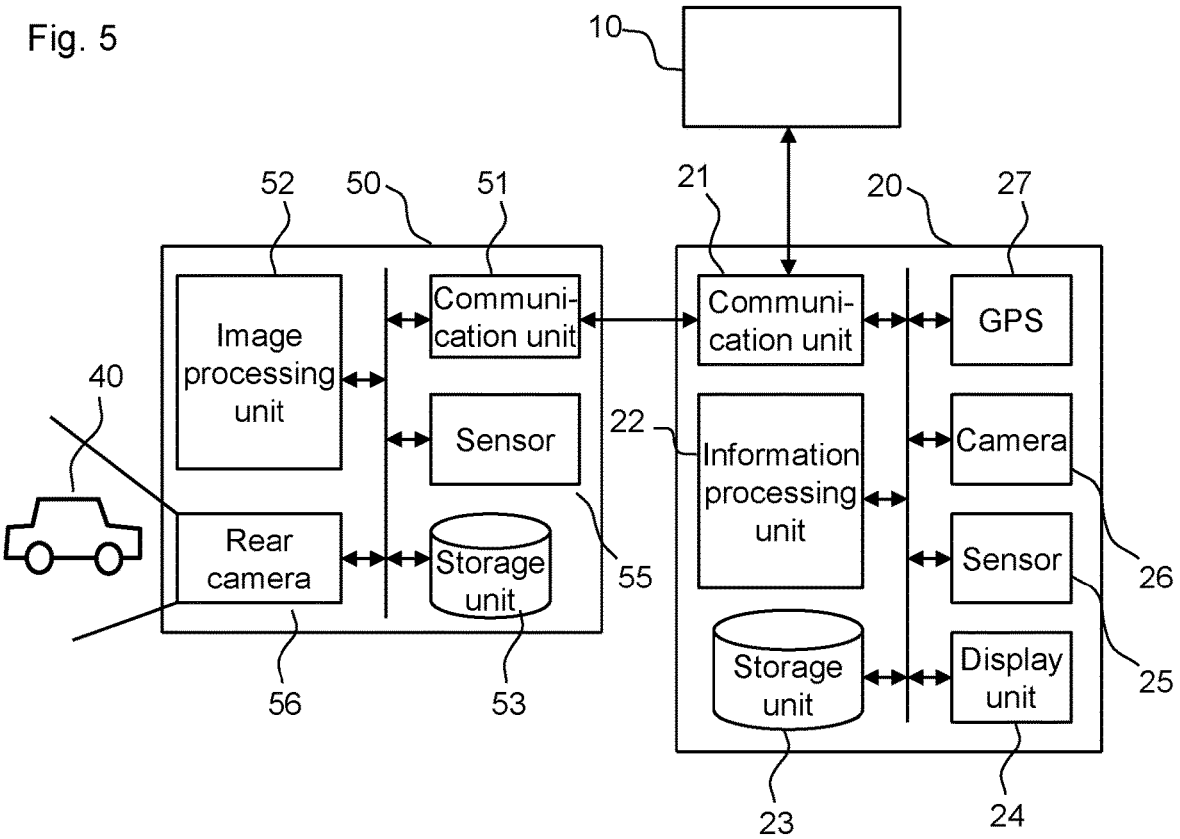
FIG. 5 is a block diagram illustrating a configuration example of a mobile information terminal and a rear unit.

In [11], the mobile information terminal (20) is provided in the front part of the moving object and is connected to a rear unit (50) so as to communicate with each other (FIGS. 4 and 5). The rear unit (50) includes a rear camera (56) and a rear image processing unit (52).

In the rear unit (50), the rear image processing unit extracts information about another moving object (40) existing in the rear direction of the moving object from the images in the rear direction captured with the rear camera, and the extracted information is transmitted to the mobile information terminal (20). In the mobile information terminal (20), when the program installed therein is operated, the program causes the information processing unit to set the transmitted information as the surround information together with the surround information extracted from the front images and transmit the surround information together with the position information to the traffic safety assistance device from the communication unit.

In this manner, other moving objects can be extracted also from rear images of the moving object, enabling collisions or abnormal approach from the rear direction to be managed. Providing the rear unit (50) with its own rear image processing unit (52) may reduce load for communicating to the front mobile information terminal (20) in the front part of the moving object and reduce information processing load on the mobile information terminal (20). If the rear unit (50) further includes a rear image storage unit (53), the rear unit (50) can be provided with a driving recorder-function for monitoring the rear direction.

[13] <Receiving Terminal>

In any one of [7] to [10], the mobile information terminal includes a display unit (24, 34) and is mounted on the moving object with the display unit disposed at a position within the field of view of a driver facing the travel direction of the moving object.

When the program installed in and operated on the mobile information terminal, the program causes the information processing unit to transmit a traffic information request together with the position information to the traffic safety assistance device from the communication unit, and display driving assistance information on the display unit based on the map information and the information about surround moving objects received from the traffic safety assistance device.

In this manner, even with a mobile information terminal that does not collect or transmit information about surround moving objects, the driver can check the driving assistance information based on the information transmitted from the traffic safety assistance device (10) and, for example, know existence of other moving objects present in blind spots. Therefore, head-on collisions can be prevented.

[14] <Smartphone for Collecting and Analyzing Traffic Information and Reporting Traffic Information to Server>

A typical embodiment of the invention is a mobile information terminal (20, 30) including a communication unit (21, 31) and an information processing unit (22, 32). The communication unit (21, 31) is capable of communicating with the traffic safety assistance device (10). The mobile information terminal (20, 30) is configured as follows (FIG. 1).

The traffic safety assistance device holds map information (2) and moving object information (1). The moving object information (1) is capable of mapping position information of each of a plurality of moving objects to the map information.

The mobile information terminal is mountable on a moving object, and the mobile information terminal causes the information processing unit to extract information about other moving objects existing around the moving object from the images of the surroundings captured from the moving object, and set the extracted information as surround information. The mobile information terminal causes the information processing unit to transmit the state of the moving object including the position information in association with the surround information the communication unit from the communication unit. Then, the mobile information terminal causes the traffic safety assistance device to update the moving object information.

In this manner, the traffic safety assistance device (10) can collect the position information of a plurality of moving objects and update them sequentially based on the transmitted information, and respond appropriately with surround information of the moving objects upon traffic information request from moving objects.

[15] <Accidents and Near Misses>

In the mobile information terminal (20, 30) of [14], the state of the moving object includes velocity or acceleration of the moving object.

In this manner, the moving object itself can use information for detecting an accident such as abnormal approach, contact, or a collision with other moving objects, or transmit the information to the traffic safety assistance device (10).

[16] <Store Images when Accidents or Near Misses Occurs>

The mobile information terminal (20, 30) of [15] has a storage unit (23, 33). When the velocity or acceleration of the moving object falls below a predetermined value specified for each, the mobile information terminal causes the information processing unit to judge that an accident or abnormal approach has occurred, and store images before and after the accident or abnormal approach in the storage unit.

In this manner, the moving object may detect accidents such as abnormal approach, contact, and collisions with other moving objects by itself and record images before and after detection of the accidents, which allows the moving object to have a driving recorder-like function.

[17] <Calculate Positions of Other Moving Objects from Surround Information>

In the mobile information terminal (20, 30) according to any one of [14] to [16], the surround information includes directions (r11, r12, r31, r32) and distances (d11, d12, d31, d32) of other moving objects from the moving object. The information processing unit calculates relative velocity or relative acceleration of other moving objects with respect to the own moving object based on the directions and distances (FIG. 3).

In this manner, the traffic safety assistance device (10) can calculate the positions of other moving objects existing around the moving object based on the transmitted information, and update the moving object information accurately. Especially even when other moving objects have no such communication means and cannot transmit their position information to the traffic safety assistance device, accurate positions of other moving objects are calculated based on the information from surround moving objects, and registered in the traffic safety assistance device (10). Thus, accidents with such moving objects can also be prevented.

[18] <Smartphone for Providing Moving Object Information to Traffic Safety Assistance Devices>

In any one of [14] to [17], the mobile information terminal includes a built-in camera (26, 36) and a display unit (24, 34). The mobile information terminal is mounted on the moving object with the display unit disposed at a position within the field of view of a driver facing the travel direction of the moving object and the built-in camera disposed at a position from which the travel direction is capturable.

The information processing unit causes the information processing unit to extract information about other moving objects existing around the moving object from images of the travel direction captured with the built-in camera, set the extracted information as surround information, and transmit the surround information together with the position information to the traffic safety assistance device from the communication unit.

In this manner, in the mobile information terminal of the invention, the program necessary for the operation thereof can be downloaded, installed, and updated as a general application program for a smartphone. Therefore, no special distribution network for distribution, maintenance, and if necessary, billing is required, which helps reduce distributing cost.

[19] <Rear Unit>

In [18], the mobile information terminal (20) is provided in the front part of the moving object and is connected to a rear unit (50) so as to communicate with each other (FIGS. 4 and 5). The rear unit (50) includes a rear camera (56) and a rear image processing unit (52).

The rear image processing unit extracts information about another moving object (40) existing in the rear direction of the moving object from the images in the rear direction captured with the rear camera (50), and the extracted information is transmitted to the mobile information terminal (20). In the mobile information terminal (20), the mobile information terminal (20) causes the information processing unit to set the transmitted information as the surround information together with the surround information extracted from the front images and transmit the surround information together with the position information to the traffic safety assistance device from the communication unit.

In this manner, other moving objects can be extracted also from rear images of the moving object, enabling collisions or abnormal approach from the rear direction to be managed. Providing the rear unit (50) with its own rear image processing unit (52) may reduce load for communicating to the front mobile information terminal (20) in the front part of the moving object and reduce information processing load on the mobile information terminal (20). If the rear unit (50) further includes a rear image storage unit (53), the rear unit (50) can be provided with a driving recorder-function for monitoring the rear direction.

[20] <Receiving Terminal>

In any one of [14] to [17], the mobile information terminal includes a display unit (24, 34), and mounted on the moving object so that the display unit is provided at a position within the field of view of the driver facing the travel direction of the moving object.

The mobile information terminal causes the information processing unit to transmit a traffic information request together with the position information to the traffic safety assistance device from the communication unit, and display map information and information about surround moving objects on the display unit. The map information is acquired as a respond based on the position information received at the traffic safety assistance device.

In this manner, even with a mobile information terminal that does not collect or transmit information about surround moving objects, the driver can check information transmitted from the traffic safety assistance device (10) and know existence of other moving objects present in blind spots. Therefore, head-on collisions can be prevented.

2. Details of the Embodiments

The embodiments will be described in more detail.

First Embodiment

FIG. 1 is a block diagram illustrating a configuration example of a traffic safety assistance device and a mobile information terminal mounted on a plurality of moving objects and capable of communicating with the traffic safety assistance device according to a first embodiment.

The traffic safety assistance device 10 is capable of communicating, via a communication network 100, with mobile information terminal 20, 30 mounted on a plurality of moving objects. In this application, the moving object may refer to any moving object in traffic, such as a pedestrian, a bicycle, a wheelchair, a motorcycle, and a car. The mobile information terminal may be a smartphone, a tablet, etc., that can be carried by a pedestrian or mounted on a bicycle, a wheelchair, a motorcycle or a car. The mobile information terminal may also be a driving assistance device including a navigation system, a driving recorder, a surround view monitor, etc. mounted on a vehicle. The moving object may include one not carrying or having a mobile information terminal mounted thereon.

The communication network 100 may be capable of communicating with the traffic safety assistance device 10 via, for example, a mobile network. Especially if the mobile network is a 5th generation (5G) network or of any generation developed in the future, such a broadband and low latency network is further suitable for the prevention of traffic accidents.

<Structure of Traffic Safety Assistance Device>

The traffic safety assistance device 10 includes an interface 13, a storage unit 11, and an information processing unit 12. More specifically, the traffic safety assistance device 10 may be a data server provided with an interface 13 for connecting to a network such as the Internet, and may be implemented by using a cloud server, for example. The storage unit 11 of the traffic safety assistance device 10 holds moving object information 1 and map information 2. The moving object information 1 includes position information of the moving objects. Some of a plurality of moving objects here have the terminals mounted thereon to be capable of communicating with the traffic safety assistance device 10 via the communication network 100 described above. Moving objects that have no such terminals mounted thereon or moving objects not carrying such terminals may also be included.

The storage unit 11 stores the moving object information 1 and the map information 2. the moving object information) includes position information of a plurality of moving objects. Each moving object is mapped to the map information 2 by using the position information. That is, each moving object is associated with the map such that where each moving object exists on the map is known based on the position information. The storage unit 11 may further store accident history information 3 and road information 4. The accident history information 3 includes position information of places where accidents occurred in the past, and is mapped to the map information 2 by using the position information. The road information 4 may include permanent attributes such as road lanes, uphill, downhill, pavement conditions, and traffic rules, as well as temporary attributes such as construction, obstacles, and lane restrictions, corresponding to the position information. The moving object information 1 and the temporary information in some of the road information 4 may desirably be deleted by, for example, being overwritten at appropriate cycles.

<Configuration of Mobile Information Terminal>

The mobile information terminal 20, 30 may be a smartphone, a tablet, etc. for example, and includes a communication unit 21, 31, an information processing unit 22, 32, a storage unit 23, 33, a display unit 24, 34, a sensor 25, 35, a camera 26, 36, and a GPS 27, 37 (see also FIG. 5 cited in the second embodiment described later). The communication unit 21, 31 is a communication interface for communicating with the traffic safety assistance device 10 via the communication network 100. The information processing unit 22, 32 is a computer configured to include a processor and memory, and executes programs installed therein. The storage unit 23, 33 is a storage unit, literally, and desirably consists of electrically rewritable non-volatile memory (including non-transitory computer-readable storage medium). The display unit 24, 34 may be a display device employing any type of displays like liquid crystal display panel and organic electro-luminescence panel. The sensor 25, 35 may desirably include sensors for sensing velocity, acceleration, direction, attitude, etc. The camera 26, 36 is capable of capturing images in the travel direction when the mobile information terminal 20, 30 is mounted on a moving object. The GPS 27, 37 is, for example, the Global Positioning System and is capable of obtaining position information of the moving object using coordinates by latitudes and longitudes.

<Operation of Traffic Safety Assistance Device>

The basic operation of the traffic safety assistance device 10 will be described.

FIG. 2 is a schematic explanatory diagram of an operation of the traffic safety assistance device 10. As a plurality of moving objects approaching an intersection, a vehicle V1, bicycles B1, B2, B3 and B4, and a pedestrian P1 are illustrated. The bicycles B1, B2, B3 and B4 each has a mobile information terminal provided in front of the driver and capable of capturing the front direction (i.e., travel direction). The bicycles B1 and B3 capture the front direction and acquire information about other moving objects, and transmit the acquired information to the traffic safety assistance device 10 together with position information of their own. In this case, information is not transmitted to the traffic safety assistance device 10 from the terminal mounted on the bicycle B2. Since the pedestrian P1 is carrying no mobile information terminal, no information is transmitted to the traffic safety assistance device 10. Here, the traffic safety assistance device 10 stores the existence of the vehicle V1, the bicycle B2, and the pedestrian P1 in association with the position information of the bicycle B1 based on the information of the surround moving objects received from the bicycle B1. The traffic safety assistance device 10 also stores the existence of the vehicle V1, the bicycle B2, and the pedestrian P1 in association with the position information of the bicycle B3 based on the information of the surround moving objects received from the bicycle B3.

In this manner, the traffic safety assistance device 10 stores, in the storage unit 11 as moving object information, the existence of the vehicle V1, the bicycle B2, and the pedestrian P1 in association with each of the position information of the bicycles B1 and B3.

Next, a case where a traffic information request has been transmitted from the mobile information terminal mounted on the bicycle B4 approaching the same intersection will be considered. From the terminal mounted on the bicycle B4, a traffic information request together with its own position information (N4, E4) is transmitted to the traffic safety assistance device 10. Upon receiving the traffic information request, the traffic safety assistance device 10 responds to the bicycle B4 with the map information 1 and the moving object information 2 in the storage unit 11 only around the position (N4, E4). If the accident history information 3 is held in the storage unit 11, the bicycle B4 may be notified of the accident history information X1 only around the position (N4, E4). Similarly, if the road information 4 is further held in the storage unit 11, the bicycle B4 may also be notified of the road information 4 only around the position (N4, E4).

Notification of the accident history information X1 allows the driver of the bicycle B4 to know the existence of moving objects entering the intersection from other directions and a fact that an accident occurred at the intersection in the past. Then, the driver of the bicycle B4 can take actions to avoid accidents, such as reducing the approach speed. Here, existence of the moving objects that cannot or do not transmit their own position information (in this example, the vehicle V1, the bicycle B2, and the pedestrian P1) may also be used in association with position information of the moving object that captured these moving objects (the bicycles B1 and B3) from the images captured from these other moving objects (the bicycles B1 and B3). In this manner, a traffic safety assistance system that can avoid accidents involving bicycles by showing the driver of the bicycle B4 risk of accidents that may occur around them using mobile information terminals mountable on the bicycle B4 can be provided.

Upon reception of a received traffic information request, the traffic safety assistance device 10 may respond to the requester (the bicycle B4) with warning information only when there is accident history information X1 around the position (N4, E4) of the requester (the bicycle B4) attached to the request and only when there are other moving objects present around the position where the accidents occurred. The traffic safety assistance device 10 may be configured to issue a warning simply when the accident history information X1 exists around the requester (the bicycle B4), but in that case, the warning may be issued too frequently and the requester (the bicycle B4) may become less warned, and the driver would disregard or ignore the warning. Therefore, the warning may be issued only when other moving objects are present around the position where accidents represented by the accident history information X1 occurred. In this manner, the warning may become more accurate to reduce the problem that the driver would disregard or ignore the warning. Here, the traffic safety assistance device 10 may respond to the requester (the bicycle B4) with the accident history information X1 and surround moving object information instead of judging whether or not to respond to the warning itself, and cause the requester (the bicycle B4) to judge whether or not to warn the driver.

It is more desirable that the travel direction (0 degrees) and the velocity (v4 m/s) of the bicycle B4 are attached to the traffic information request transmitted from the bicycle B4. This is because the traffic safety assistance device 10 that has received such a traffic information request can calculate not the position of the bicycle B4 (N4, E4) at the time of request by the bicycle B4 but the position at the time when the bicycle B4 receives the response as illustrated in FIG. 3 based on the travel direction (0 degrees) and the velocity (v4 m/s), and then respond to the bicycle B4 with map information, moving object information, accident history information, and road information of the area in the travel direction from that position.

In this manner, accurate information can be provided even when there is significant delay in the communication network between the traffic safety assistance device 10 and the moving object B4.

Further, for example, the accident history information X1 can be provided as a response to the requester (the bicycle B4) or used to warn the requester (the bicycle B4) not when an accident history is around the requester but only when the accident history is in the travel direction, which enables provision of more accurate warnings.

Further, inclusion of information about the travel direction and the velocity not only in the moving object (the bicycle B4) requesting traffic information but also in the information of other moving objects stored in the traffic safety assistance device 10 is more desirable. For example, when a warning is to be issued to the driver based on the accident history information X1 around the requester (the bicycle B4), a warning may be issued only when there is a possibility of a collision to occur in consideration of the travel direction of the requester (the bicycle B4) and other moving objects. Alternatively, severity or urgency of a warning may be varied based on the likelihood of occurrence of a collision. Furthermore, severity of a warning may be varied based on the similarity with the accident that occurred in the accident history information X1. For example, warnings of low severity may be set not to be displayed. In this manner, accuracy of the provided driving assistance information can be improved, and a traffic safety assistance system capable of further effectively avoiding accidents involving bicycles can be provided.

As described above, the traffic safety assistance device 10 holds the accident history information 3 in the storage unit 11, extracts history of an accident that occurred in the past around or in the travel direction of the moving object upon request of a traffic information request, and responds to the moving object requesting the traffic information. These are warning to the driver of the moving object for the prevention of similar accidents.

<Receive-Only Terminal>

The mobile information terminal described so far transmits surround moving object information extracted from captured camera images to the traffic safety assistance device 10. There may be, however, also a receiving terminal dedicated for receiving information. Such a receiving terminal extracts its own position information, transmits the extracted position information to the traffic safety assistance device 10 attached to the traffic information request. Then, the receiving terminal receives map information, moving object information, accident history information, and traffic information in the surround area as a response from the traffic safety assistance device 10 as described above.

In this manner, the driver can check the information transmitted from the traffic safety assistance device 10 and know the existence of other moving objects in blind spots. Therefore, head-on collisions can be prevented.

Second Embodiment

The traffic safety assistance device 10 calculates positions of surround moving objects of the bicycle B1 and the bicycle B3 from each of position information and surround moving object information transmitted from the bicycle B1 and the bicycle B3, thereby improving accuracy in moving object information stored in the storage unit 11.

FIG. 3 is an explanatory diagram illustrating an exemplary method of calculating position information of other moving objects. Here, in accordance with FIG. 2, the position information (N1, E1) and the travel direction "+90 degrees," the bicycle B2 being positioned at an angle r12=−30 degrees from the travel direction of the bicycle B1 as information about other moving objects, and the pedestrian P1 being positioned at an angle r11=+20 degrees from the travel direction of the bicycle B1 are transmitted to the traffic safety assistance device 10 from the bicycle B1. Further, the position information (N3, E3) and the travel direction "−90 degrees," the bicycle B2 being positioned at an angle r32=+25 degrees from the travel direction of the bicycle B3 as information about other moving objects, and the pedestrian P1 being positioned at an angle r31=−8 degrees from the travel direction of the bicycle B3 are transmitted to the traffic safety assistance device 10 from the bicycle B3. As illustrated in FIG. 3, when the travel directions and the angles from the travel directions of the bicycle B1 and the bicycle B3 are drawn based on the coordinates corresponding to the position information of the bicycle B1 and the bicycle B3, the positions of the bicycle B2 and the pedestrian P1 can be calculated as the coordinates of the intersections.

For ease of understanding, the directions of other moving objects from the two moving objects, the bicycles B1 and B3, are notified in this example. However, positions of other moving objects can be calculated based only on information from a single moving object. For example, in addition to the position (N1, E1) of the bicycle B1 and the angle r12=−30 degrees from the travel direction when the bicycle B2 is viewed from the bicycle B1, the distance d12 may be notified. The distances d12 to the bicycle B2 and d11 to the pedestrian P1 which are other moving objects from the images captured the front direction of the bicycle B1 can be obtained through, for example, calculation of relative relationships with some objects in the background or subjects of which distance and size are already known.

The traffic safety assistance device 10 stores the calculated position information in the storage unit 11 as moving object information instead of the information that the bicycle B2 and the pedestrian P1 are simply present in the vicinity thereof.

When a traffic information request is transmitted from the mobile information terminal mounted on the bicycle B4 approaching the same intersection together with its own position information (N4, E4), the traffic safety assistance device 10 responds to the bicycle B4 based on the calculated position information about the bicycle B2 and the pedestrian P1. If the accident history information 3 is held in the storage unit 11, the traffic safety assistance device 10 notifies the bicycle B4 of the accident history information X1 only around the position (N4, E4) similarly. When the position information of the bicycle B2 and the pedestrian P1 is common or similar to that of the accident history information X1, the bicycle B4 may be responded with higher priority or urgency. Or warnings with lower priority may be set not to be issued. As described in the first embodiment, if warnings are issued too frequently, they can be disregarded or ignored by the driver; therefore, warnings may desirably be issued at appropriately-set priority level. Priority level at which a warning is to be issued may be set by a user.

In this manner, the driver of the bicycle B4 can know not only the existence of the moving object entering the intersection from another direction but also the position thereof, as well as accident history in that intersection. Then, the driver of the bicycle B4 can take actions to avoid accidents such as reducing the approach speed.

As in the first embodiment, it is more desirable that the travel direction (0 degrees) and the velocity (v4 m/s) of the bicycle B4 are attached to the traffic information request transmitted from the bicycle B4. This is because the traffic safety assistance device 10 that has received such a traffic information request can calculate not the position of the bicycle B4 (N4, E4) at the time of request but the position at the time when the bicycle B4 receives the response as illustrated in FIG. 3 based on the travel direction (0 degrees) and the velocity (v4 m/s), and then respond to the bicycle B4 with map information, moving object information, accident history information, and road information of the area in the travel direction from that position. In this manner, accurate information can be provided even when there is significant delay in the communication network between the traffic safety assistance device 10 and the moving object B4. Further, as described in the first embodiment, priority or urgency of the warning may be adjusted based on the similarity to the past accident history information, so that warnings can be issued with appropriate priority.

As described above, the traffic safety assistance device 10 holds the accident history information 3 in the storage unit 11, extracts history of an accident that occurred in the past around or in the travel direction of the moving object upon request of a traffic information request, and responds to the moving object requesting the traffic information. These are warning to the driver of the moving object for the prevention of similar accidents.

Third Embodiment

The mobile information terminal mountable on the moving object is desirably a smartphone or tablet provided with a built-in camera and a display unit. When the moving object is a bicycle, a rear unit having a built-in camera may be provided in the rear part in addition to a smartphone provided in the front part of the bicycle.

FIG. 4 is an image diagram illustrating an embodiment when the moving object is a bicycle. FIG. 5 is a block diagram illustrating a configuration example of a mobile information terminal and a rear unit.

As illustrated in FIG. 4, the smartphone 20 is desirably fixed to, for example, a handlebar of a bicycle so that the driver can see the display unit when facing the travel direction and the built-in camera 26 can capture images in the travel direction. It is desirable that the smartphone is fixed to a detachable folder so that the driver can remove and carry it after parking and leaving the bicycle. A rear unit 50 may be provided in the rear part of the bicycle. The rear unit 50 has a built-in camera 56 capable of capturing the rear direction. The smartphone 20 and the rear unit 50 may be capable of communicating wirelessly.

As illustrated in FIG. 5, the smartphone 20 includes a communication unit 21, an information processing unit 22, a storage unit 23, a display unit 24, a sensor 25, a camera 26 and a GPS 27. The communication unit 21 is a communication interface for communicating with the traffic safety assistance device 10. The information processing unit 22 is a computer that is configured to include a processor and memory, and executes programs installed therein. The storage unit 23 is a storage unit, literally, and desirably consists of electrically rewritable non-volatile memory. The display unit 24 is, for example, a liquid crystal display device or an organic electro-luminescence display device. The sensor 25 may be various sensors, and may desirably include sensors for velocity, acceleration, direction, and attitude. The camera 26 is for capturing images in the travel direction when the mobile information terminal 20 is mounted on a moving object. The GPS 27 is, for example, the Global Positioning System and is capable of obtaining position information of the moving object using coordinates by latitudes and longitudes.

The rear unit 50 includes, for example, a communication unit 51, an image processing unit 52, a storage unit 53, a sensor 55, and a camera 56. The communication unit 51 is an interface for communicating with the smartphone 20. Wired communication is acceptable, but wireless is desirable. The communication system adopted is, for example, wireless LAN (Large Area Network) and short-range wireless communication such as Bluetooth (registered trademark). The storage unit 53 is a storage unit, literally, and desirably consists of electrically rewritable non-volatile memory. The sensor 55 may be various sensors, and may desirably include sensors for velocity, acceleration, direction, and attitude. The image processing unit 52 can perform image processing for detecting moving objects such as bicycles and pedestrians from images captured with the camera 56, and perform control such as transmitting the image processing result from the communication unit 51, storing the images in the storage unit 53, etc.

<Application Software>

A program for executing the following process may be installed in and operated on the smartphone 20 as an application program. The process includes extracting position information from the GPS 27, capturing images with the camera 26, and extracting moving object information from the captured images on the smartphone 20. The program to be executed by the rear unit 50 may be installed from the smartphone 20. Like general application software, these programs may be downloaded from a server, installed, and updated upon version upgrade or the like. If the distribution network similar to that of general application software is used as it is, no special distribution network for distribution, maintenance, and if necessary, billing is required, which helps reduce distributing cost.

<Extract and Recognize Moving Objects from Images>

Extraction and recognition of moving objects from the images captured with the camera 26 of the smartphone 20 and extraction and recognition of moving objects from the images captured with the camera 56 of the rear unit 50 can be performed using a publicly known image recognition processing algorithm. Alternatively, images captured with the camera 56 of the rear unit 50 may be transferred to the smartphone 20 so that image processing for both front and rear sides can be executed by the smartphone 20. It is more desirable that processing of images captured with the camera 56 is performed in the rear unit 50 for the following reasons: communication data amount with the smartphone 20 may be reduced, no arbitration between two image processing tasks, and no performance overhead occurs upon task switching, whereby entire calculation load may be reduced.

The images captured with the cameras 26, 56 may be moving images or still images. Since the images are captured with a camera provided in a moving object bumping over a road such as a bicycle, image angle adjustment and image stabilization are performed based on attitude information from an attitude sensor included in the sensor 25 and acceleration information obtained from an acceleration sensor, and the number, size, type, moving direction, velocity, etc. of moving objects are extracted based on contour extraction, feature extraction, motion detection, etc. Machine-learned artificial intelligence (AI) may be used for recognition of types of moving objects. The distance to the moving object can be calculated from the size of the moving object in the image and the average size of the moving object based on AI recognition of types of moving objects. The distance to the moving object may also be calculated from the focal point of the camera. In addition, in image processing, landmarks (traffic lights, road signs, etc.) useful for identifying the position of a moving object may be additionally extracted from the background image.

Fourth Embodiment

Terminals mounted on moving objects may be set to detect occurrence of an accident and notify the traffic safety assistance device 10 of the detected information. The traffic safety assistance device 10 may be set to add the detected information to the accident history information 3 in the storage unit 11. The terminal may detect abnormal approach, sudden braking, sudden change of direction, and falls, although they are not accidents, notify the traffic safety assistance device 10 as a similar-accident case, and add it to the accident history information 3 in the same way.

In this manner, the traffic safety assistance device can learn and accumulate accident cases and potential accident cases (sometimes called "near misses") and can respond with new accident history or warning information similar to accident history upon request to provide traffic information by other moving objects. Therefore, probability of future occurrence of accidents can further be reduced.

A mobile information terminal, e.g., the smartphone 20, can detect a collision, sudden braking, a sudden change of direction, or a fall by using the velocity sensor, the acceleration sensor, and the attitude sensor mounted thereon. Upon a collision or sudden braking, the acceleration becomes a large negative value, the velocity becomes 0, and the vehicle stops. In sudden change of direction, the acceleration and the velocity in the initial travel direction suddenly decrease and the velocity and the acceleration in another direction is changed suddenly. Such a sudden change of direction can be detected by using an attitude sensor together. A sudden change in velocity or direction may also be detected from the images captured with the camera 26. That is, a sudden change in velocity or direction can be detected by motion detection in the images.

When the rear unit 50 is mounted, detection can be performed similarly by using the sensor 55 in the rear unit 50 or from the images captured with the camera 56.

<Driving Recorder>

In a mobile information terminal 20 such as a smartphone or a rear unit 50 configured to detect an accident or a similar-accident case, when an accident or a similar-accident case is detected, image information and information such as velocity, acceleration, and posture before and after the accident may be stored in the storage unit 23 of the mobile information terminal 20 and in the storage unit 53 of the rear unit 50. Since the storage capacity of the storage unit 23 and 53 is not inexhaustible, while ordinary images and sensor information are overwritten after being stored, information about such accidents or cases similar to accidents may be stored in areas in which information is not overwritten.

This allows the mobile information terminal 20 and the rear unit 50 to have a driving recorder-like function. Further, when the mobile information terminal 20 or the rear unit 50 are later requested by the traffic safety assistance device 10 to provide detailed information (see "Learn accidents and Near Misses" described later), the mobile information terminal 20 or the rear unit 50 can provide the information to the traffic safety assistance device 10.

<Expand Near Misses>

The following cases may also be detected: moving objects around the own moving object are forced to brake or change direction suddenly even if the own moving object does not make a sudden stop; or the own moving object is not involved in but becomes a witness of an accident.

For example, since movement of surround moving objects may be extracted through analyzation of images captured with the camera 26 or the camera 56 of the rear unit 50, the mobile information terminal 20 may judge a collision or sudden braking has occurred or detect abnormal approach from the positions, directions, and acceleration of the moving objects calculated from the movement. Positions of two moving objects are calculated from images thereof and the distance therebetween is calculated. If the distance falls below the predetermined value, it can be judged as abnormal approach. A mere passing each other can result in a distance equivalent to abnormal approach, but acceleration is not large. If large negative acceleration is caused at the same time as the distance decreases, it can be judged to be abnormal. Large negative acceleration of a moving object approaching itself can be judged as an abnormal approach case where the approached moving object is one party.

The traffic safety assistance device 10 can be notified of such a case as a similar-accident case. Further, the images and sensor information before and after the case may be stored in the storage unit 23, 53 for future detailed analysis.

<Learning of Accidents and Near Misses>

When the traffic safety assistance device 10 receives a notification of such an accident or a similar-accident case as described above, the traffic safety assistance device 10 adds the accident or the case to the accident history information 3 in the storage unit 11. At this time, it is desirable to store the situation of the accident or the similar-accident case. For example, when the accident case X1 that occurred at an intersection is to be stored in the accident history information 3 by citing FIG. 3, the accident case X1 will be stored as a contact accident occurred near the southeast corner caused by bicycles entering the intersection from the east and the south. This accident history can be used in order to prioritize warnings to prevent accidents similar to those occurred in the past: for example, the strongest warning to the bicycle entering the intersection from the east keeping to the right; a weaker warning to the pedestrian from the east keeping to the right; and also a weaker warning to the bicycle from the south keeping to the left.

While the invention made by the inventor has been particularly described with respect to the embodiments thereof, the invention is not limited thereto and other changes may be made therein without departing from the spirit and scope of the invention.

INDUSTRIAL APPLICABILITY

The invention relates to a traffic safety assistance device and a program. The program is installed in a mobile information terminal that is capable of communicating with the traffic safety assistance device. The invention is used especially suitably for avoidance of bicycle collision accidents.

EXPLANATION OF SIGN

1 Moving object information
2 Map information
3 Accident history information
4 Road information
10 Traffic safety assistance device
11 Storage unit
12 Information processing unit
56 Interface
20, 30 Mobile information terminal
21, 31 Communication unit
22, 32 Information processing unit
23, 33 Storage unit
105, 115, 125 Display unit
25, 35 Sensor
26, 36 Camera
27,37 GPS unit
40 Moving object
50 Rear unit
51 Communication unit
52 Image processing unit
53 Storage unit
55 Sensor
56 Camera
B1, B2, B3, B4, P1, V1 Moving object
X1 Accident history information
100 Communication network

The invention claimed is:

1. A traffic safety assistance device, comprising an interface capable of communicating with a plurality of moving objects; a storage unit capable of holding moving object information and map information, the moving object information including position information of one or some of the plurality of moving objects; and an information processing unit, wherein:

the information processing unit stores map information in the storage unit, wherein position information of a first moving object input via the interface from a terminal mounted on the first moving object and existence of a second moving object that is extracted from images captured from the first moving object are mapped onto the map information as moving object information;

the information processing unit updates the moving object information stored in the storage unit; and in response to a traffic information request transmitted, via the interface, together with position information of a third moving object input from a terminal mounted on the third moving object, the information processing unit transmits map information wherein the updated moving object information is mapped in a predetermined range based on the position of the third moving object to the terminal mounted on the third moving object.

2. The traffic safety assistance device according to claim 1, wherein the storage unit further stores accident history information, and when there is accident history information corresponding to the position information of the third moving object attached to the traffic information request, the information processing unit transmits, to the terminal mounted on the third moving object, warning information regarding the accident history information based on a relationship with the accident history information from the moving object information stored in the storage unit.

3. The traffic safety assistance device according to claim 2, wherein:

the information input from the terminal mounted on the first moving object includes velocity and acceleration of the first moving object and distance information to the second moving object; and when the distance to the second moving object and at least one of velocity or acceleration in the first moving object are equal to or less than a predetermined value specified for each, the information processing unit judges that the first moving object and the second moving object have collided with or abnormally approached each other, adds the judgement result to the accident history information and store the same in the storage unit.

4. The traffic safety assistance device according to claim 3, wherein when the information processing unit judges that the first moving object and the second moving object has abnormally approached each other, the information processing unit requests the terminal mounted on the first moving object to provide image information at the time of the abnormal approach via the interface.

5. The traffic safety assistance device according to claim 1, wherein:

the traffic information request transmitted from the terminal mounted on the third moving object further includes information about a travel direction and velocity of the third moving object; and the information processing unit estimates the position of the third moving object at the time when the response is received by the terminal mounted on the third moving object based on the travel direction and the velocity of the third moving object, and then transmits map information and information about other moving objects around the position corresponding to the estimated position to the terminal mounted on the third moving object.

6. The traffic safety assistance device according to claim 1, wherein:

the information processing unit calculates the position of the second moving object based on the position information of the first moving object and information about the second moving object, and then stores the calculated position in the storage unit as moving object information; and in response to the traffic information request, the information processing unit transmits information based on the calculated position of the second moving object to the terminal mounted on the third moving object.

7. A non-transitory computer-readable storage medium storing a program for operation on a mobile information terminal, wherein:

the mobile information terminal, which is mountable on a moving object, comprising a communication unit and an information processing unit, the communication unit being configured to communicate with a traffic safety assistance device;

the traffic safety assistance device holds map information and moving object information wherein the moving object information includes position information of each of a plurality of moving objects to be mapped on the map information;

the program causes the information processing unit to extract information about other moving objects existing around the moving object from images of surroundings of the moving object, and set the extracted information as surround information; and the program causes the information processing unit to transmit position information of the moving object and the surround information in association with the position information of the moving object from the communication unit to the traffic safety assistance device, whereby the traffic safety assistance device is made to update the moving object information with the surround information and map the updated moving object information onto the map information; and the program causes the information processing unit to transmit a traffic information request together with the position information to the traffic safety assistance device from the communication unit, and causes the communication unit to receive the map information updated of the moving object information within the predetermined range based on the position information transmitted with the traffic information request.

8. The non-transitory computer-readable storage medium according to claim 7, wherein the program causes the information processing unit to transmit state of the moving object includes velocity or acceleration of the moving object to the traffic safety assistance device.

9. The non-transitory computer-readable storage medium according to claim 8, wherein, when the velocity or the acceleration of the moving object falls below a predetermined value specified for each, the program causes the information processing unit to judge that an accident or abnormal approach has occurred and store images before and after the accident or abnormal approach in a storage unit.

10. The non-transitory computer-readable storage medium according to claim 7, wherein the surround information includes directions and distances of other moving objects from the moving object.

11. The non-transitory computer-readable storage medium according to claim 7, wherein the mobile information terminal includes a built-in camera and a display unit, wherein:

the mobile information terminal is mounted on the moving object with the display unit disposed at a position within the field of view of a driver facing the travel direction of the moving object and the built-in camera disposed at a position from which the travel direction is capturable;

the program causes the information processing unit to extract information about other moving objects existing around the moving object from images of the travel direction captured with the built-in camera, set the extracted information as surround information, and set the position information transmitted from the communication unit to the traffic safety assistance device.

12. The non-transitory computer-readable storage medium according to claim 11, wherein the mobile information terminal is provided in the front part of the moving object and is configured to communicate with a rear unit, the rear unit including a rear camera and a rear image processing unit; and the program causes the rear image processing unit to extract information about other moving objects existing in the rear direction of the moving object from the images captured with the rear camera, set the extracted information as the surround information together with the surround information extracted from the front images and transmit the surround information to the traffic safety assistance device from the communication unit together with the position information.

13. The non-transitory computer-readable storage medium according to claim 7, wherein the mobile information terminal comprises a display unit and is mounted on the moving object so that the display unit is disposed at a position within the field of view of the driver facing the traveling direction of the moving object; and the program causes the information processing unit to transmit a traffic information request together with the position information to the traffic safety assistance device from the communication unit, and display driving assistance information on the display unit based on the map information and information about surround moving objects received at the traffic safety assistance device.

14. A mobile information terminal, which is mountable on a moving object, comprising a communication unit and an information processing unit, the communication unit being capable of communicating with a traffic safety assistance device, wherein:

the traffic safety assistance device holds map information and moving object information in a storage unit, the moving object information being capable of mapping position information of each of a plurality of moving objects on the map information;

the mobile information terminal causes the information processing unit to extract information about other moving objects existing around the moving object from images of surroundings captured from the moving object, set the extracted information as surround information;

the mobile information terminal causes the information processing unit to transmit position information of the moving object and the surround information in association of the position information to the traffic safety assistance device from the communication unit, whereby the traffic safety assistance device is made to update the moving object information with the surround information and map the updated moving object information onto the map information; and the mobile information terminal causes the information processing unit to transmit a traffic information request together with position information of the moving object from the communication unit to the traffic safety assistance device and receive map information with the updated moving object information based on the position information from the traffic safety assistance device.

15. The mobile information terminal according to claim 14, wherein the mobile information terminal causes the information processing unit to transmit state of the moving object includes velocity or acceleration of the moving object.

16. The mobile information terminal according to claim 15, wherein, when the velocity or the acceleration of the moving object falls below a predetermined value specified for each, the information processing unit judges that an accident or abnormal approach has occurred and store images before and after the accident or abnormal approach in a storage unit.

17. The mobile information terminal according to claim 14, wherein the surround information comprises directions and distances to other moving objects from the moving object.

18. The mobile information terminal according to claim 14, wherein:

the mobile information terminal comprises a built-in camera and a display unit, the display unit being mounted on the moving object at a position within the field of view of the driver facing the travel direction of the moving object and the built-in camera at a position from which the travel direction is capturable; and the mobile information terminal causes the information processing unit to extract information about other moving objects existing around the moving object from images of the travel direction captured with the built-in camera, set the extracted information as surround information, and set the position information transmitted from the communication unit to the traffic safety assistance device.

19. The mobile information terminal according to claim 18, wherein:

the mobile information terminal is mounted in the front part of the moving object and is configured to communicate with a rear unit, the rear unit including a rear camera and a rear image processing unit;

the rear image processing unit extracts information about other moving objects existing in the rear direction of the moving object from images captured with the rear camera; and the mobile information terminal sets the information extracted by the rear image processing unit as the surround information together with the surround information extracted from the front images and transmits the surround information together with the position information from the communication unit to the traffic safety assistance device.

20. The mobile information terminal according to claim 14, wherein:

the mobile information terminal comprises a display unit and is mounted on the moving object so that the display unit is arranged at a position within the field of view of the driver facing the traveling direction of the moving object; and the mobile information terminal causes the information processing unit to transmit a traffic information request to the traffic safety assistance device from the communication unit together with the position information, and display map information and information about surround moving objects on the display unit acquired as a respond based on the position information received at the traffic safety assistance device.

* * * * *